United States Patent [19]

Gulliver

[11] Patent Number: 5,006,166

[45] Date of Patent: Apr. 9, 1991

[54] RECOVERY OF NOBLE METALS

[75] Inventor: David J. Gulliver, Hull, England

[73] Assignee: BP Chemicals Limited, London, England

[21] Appl. No.: 260,193

[22] Filed: Oct. 20, 1988

[30] Foreign Application Priority Data

Oct. 24, 1987 [GB] United Kingdom ..... 8724972

[51] Int. Cl.[5] ..... B01J 80/11; C01G 55/00

[52] U.S. Cl. ..... 75/413

[58] Field of Search ..... 75/413

[56] References Cited

U.S. PATENT DOCUMENTS 3,887,489 6/1975 Fannin ..... 74/413

FOREIGN PATENT DOCUMENTS 2094284 9/1982 United Kingdom .

*Primary Examiner*—Peter D. Rosenberg

*Attorney, Agent, or Firm*—Brooks Haidt Haffner & Delahunty

[57] ABSTRACT

A process for recovering Group VIII noble metals from tar is provided. The process involves heating a mixture of the Group VIII noble metal, tar and methyl iodide in a closed system at a temperature in excess of 50° C. During the process the Group VIII noble metal is precipitated in an insoluble form which can be separated by e.g. filtration. Precipitation preferably takes place at a temperature in the range 120° to 180° C. The process is particularly suitable for the recovery of either rhodium or iridium.

11 Claims, 2 Drawing Sheets

RHODIUM PRECIPITATION EFFICIENCY
AS A FUNCTION OF TEPERATURE

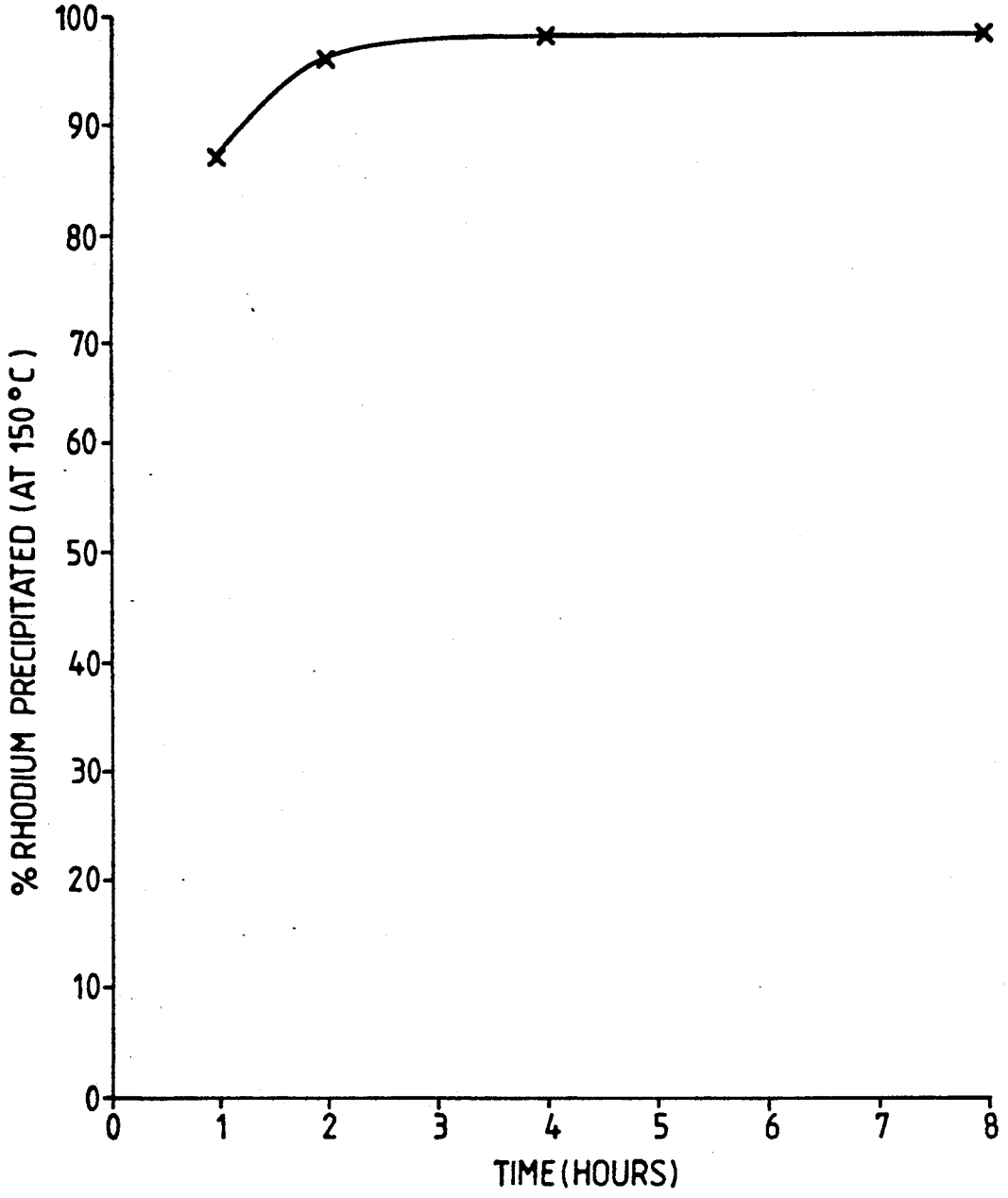
100
90
80
70
60
50
40
30
20
10
0
% RHODIUM PRECIPITATED (AT 150°C)
0
1
2
3
4
5
6
7
8
TIME (HOURS)

RECOVERY OF NOBLE METALS

The present invention relates to a process for recovering a noble metal from the tar produced as by-product in a carbonylation process. In particular, the present invention relates to a process in which the noble metal is recovered from the tar by precipitation at elevated temperature. In a preferred form, the process of the present invention is one which is employed to treat tars which have previously undergone a primary recovery process.

Group VIII noble metal catalysed carbonylation processes are now well known in the art and are in some cases operated commercially. Typical examples of such processes include (a) the rhodium catalysed hydroformylation of olefins to higher alcohols, aldehydes and ketones; (b) the rhodium catalysed carbonylation of methanol to acetic acid; (c) the rhodium catalysed carbonylation of methyl acetate to acetic anhydride or ethylidene diacetate and (d) the rhodium catalysed carbonylation of methyl acetate, water and methanol to produce both acetic anhydride and acetic acid as described in EP 87870. Since such catalysts are extremely expensive, successful commercial operation requires that catalyst loss be minimised.

A problem often encountered with processes of this type is that, in addition to the desired products, there is often formed, as by-product, considerable quantities of high molecular weight organic polymers (tar). On commercial plants, where high boiling materials and catalyst tend to be continually recycled, the formation of such tars is particularly undesirable since they tend to build up in the carbonylation reactor and eventually reduce the rate of carbonylation and hence the output of the plant. To avoid build up of such tars, it is therefore necessary to remove continually a side stream from the catalyst recycle stream or from the carbonylation reactor and treat it in a way such that the tar is separated from any Group VIII noble metal catalyst and any associated promoters and copromoters. The Group VIII noble metal catalyst and associated promoters and copromoters can then be recovered and returned directly or indirectly to the carbonylation reactor whilst the tars can be disposed of.

One approach to solving this problem has been described in U.S. Pat. No. 4388217. The process, which is suitable for treating tars which arise during the production of acetic anhydride by the rhodium catalysed, iodide promoted, lithium copromoted reaction of methyl acetate with carbon monoxide, comprises contacting a reactor side stream containing tar, rhodium catalyst, iodide promoter and lithium copromoter, after dilution with methyl iodide, with aqueous hydroiodic acid in a countercurrent extractor. During the extraction, the rhodium, iodide and lithium migrate into the aqueous phase whilst the water immiscible tar and methyl iodide remain as a separate organic phase. The two phases are separated after the extraction by known methods and the tar disposed of after further separation from the methyl iodide. As regards the aqueous hydroiodic acid leaving the extractor this can be treated to recover the rhodium, iodide and lithium components which are then recycled to the carbonylation reactor.

Another approach, which has been described in our copending European patent application 255389, uses aqueous acetic acid in place of the highly corrosive aqueous hydroiodic acid.

A further approach has been described in GB 2099428 involves extracting the tar into a solvent such as a cycloalkane, alkane, halogenated alkane or an aromatic hydrocarbon.

Finally, GB 2094284 describes a process where the noble metal catalyst is freed from the tar by (a) treatment with an amine or hydrazine followed by (b) treatment with an aqueous halogen acid.

Even though the processes described above are efficient in their ability to recover Group VIII noble metals, the high cost of the noble metal still makes it worthwhile to treat further the spent tar/methyl iodide mixture prior to disposal of the tar in order to remove the small amounts of Group VIII noble metal which have not been successfully extracted. Accordingly, therefore, it is desirable to develop a secondary recovery process which can be employed in conjunction with a primary process of the type disclosed above.

U.S. Pat. No. 3,887,489 discloses a method for regenerating a spent rhodium catalyst from a solution containing hydrogen iodide, water, acetic acid and metallic corrosion products. The process described involves heating the mixture to a temperature in the range 100° to 190° C. However, the process disclosed occurs in an open system which leads to the boiling out of any alkyl halide present.

In the course of developing a suitable secondary recovery process, it has been discovered that Group VIII noble metals can be efficiently recovered from tar/-methyl iodide mixtures by heating the mixture to elevated temperature in a closed system.

According to the present invention there is provided a process for recovering a Group VIII noble metal from a mixture consisting essentially of the Group VIII noble metal, tar and methyl iodide which comprises the steps of (a) preparing a mixture consisting essentially of the Group VIII noble metal, tar and methyl iodide, (b) feeding the mixture into a vessel, (c) isolating the inside of the vessel from the outside, (d) heating the vessel and its contents to a temperature in excess of 50° C., (e) removing a mixture consisting essentially of tar and methyl iodide from the vessel and (f) removing the Group VIII metal in solid form from the vessel.

Brief Description of the Drawings

FIG. 2 shows Rhodium Precipitation Efficiency as a function of time.

Figure 1:
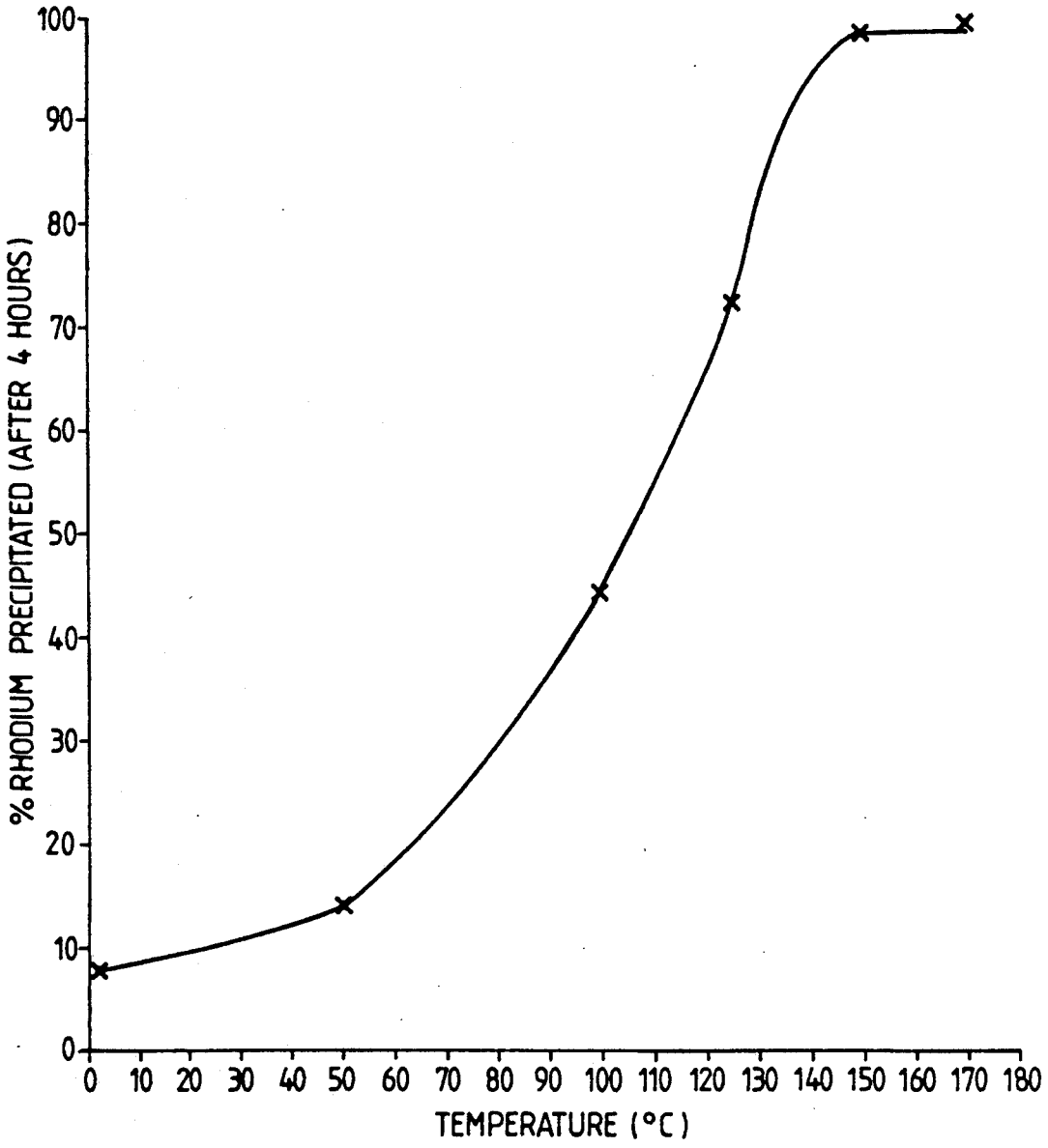
FIG. 1 shows Rhodium Precipitation Efficiency as a function of temperature.

It will be appreciatec that it is necessary to heat the mixture in a closed system since the boiling point of methyl iodide at atmospheric pressure is only 42.4° C.

It has been observed that the higher the temperature, the higher the rate of precipitation of the Group VIII noble metals. However above a temperature of ca 180° C. no further benefit accrues. It is preferred therefore to heat the mixture to a temperature in the range 120° to 180° C. most perferably 140° to 180° C.

The heating of the mixture may take place under an autogenous pressure provided by the methyl iodide. Alternatively an overpressure of nitrogen or air may be applied to the inside of the vessel. Whilst carbon monoxide and or hydrogen can be used to generate the overpressure, it has been observed that their presence tends to inhibit the precipitation of the Group VIII noble metal. Hence if they are used they should be present only in small amounts.

As mentioned above the process of the present invention is particularly suitable for use as a secondary recovery process in association with one of the two processes described previously.

Thus, it is preferred that step (a) comprises the steps of (i) mixing a carbonylation process stream, which consists essentially of a Group VIII noble metal catalyst and tar, with methyl iodide, (ii) contacting the mixture produced in step (i) with an extracting stream comprising either acqueous hydroiodic acid or aqueous acetic acid under conditions where at least 50% of the Group VIII noble metal is extracted into the extracting stream and the mixture and (iii) separating the extracting stream and the mixture. The mixture produced in step (iii) which consists essentially of the residual Group VIII noble metal, tar and methyl iodide can then be fed to the vessel as defined in step (b). It is preferred that in step (ii) above at least 80%, most preferably at least 90%, of the Group VIII metal is removed.

Turning to steps (e) and (f), although these can be performed sequentially it is preferred to combine them and remove both components from the vessel simultaneously. If this approach is adopted then it is preferred to separate the solid Group VIII noble metal from the tar and methyl iodide by subsequent filtration. Before filtration it is preferred that the components are cooled to less than 100° C., preferably less than 75° C.

After separation the solid Group VIII metal can be redissolved in a suitable reaction medium and reused.

Although in principle the processes of the present invention may be applied to recovering any Group VIII noble metal, they are particularly suitable for the recovery of rhodium and iridium. It is believed that the process of the present invention causes the rhodium or iridium to be converted into the insoluble triiodide form, although such a theory is not intended to be construed as limiting.

The process described above is essentially a batch type process. However, the process of the present invention can be operated continuously by employing a vessel whose inside is continuously isolated from the outside under an applied, rather than an autogenous, pressure.

The invention is now illustrated by the following examples wherein the tar is of a type produced by a process according to EP 87870.

EXAMPLES A process having the composition

| | |
|---|---|
| Rh | 170 ppm |
| Tar | 4% wt |
| Methyl iodide | 82% wt |
| Acetic acid | 14% wt |

was employed as a model to test the efficiency of the process. The process stream also contained traces (<1%) of methyl acetate, water, ethylidene diacetate and N,N'-dimethylimidazolium iodide.

Aliquots of the process stream (30 mls ca 55 g) were transferred into a series of Fischer Porter tubes. Each tubes was then flushed with nitrogen gas and sealed. Each tube was heated in an oil bath to the desired temperature for the appropriate length of time. At the end of the time the contents of each tube were recovered and filtered at 50° C. The filtrate was analysed for rhodium by atomic absorption spectroscopy.

From the analysis the rhodium precipitation efficiency was calculated. This figure is defined as $$\text{Rh precipitation efficiency \%} = \frac{100 \times (\text{Rh in } CH_3I \text{ extract (g)} - \text{Rh in Filtrate (g)})}{\text{Rh in methyl iodide extract (g)}}$$

The results are given in FIGS. 1 and 2. In FIG. 1 the tubes were heated for 4 hours. In FIG. 2 the temperature used was 150° C.

I claim:

1. A process for recovering a Group VIII noble metal from a mixture consisting essentially of the Group VIII noble metal, tar and methyl iodide which comprises the steps of (a) preparing a mixture consisting essentially of the Group VIII noble metal, tar and methyl iodide, (b) feeding the mixture into a vessel, (c) isolating the inside of the vessel from the outside, (d) heating the vessel and its contents to a temperature in excess of 50° C., (e) removing a mixture consisting essentially of tar and methyl iodide from the vessel and (f) removing the Group VIII metal in solid form from the vessel.

2. A process as claimed in claim 1 wherein step (a) comprises the further steps of: (i) mixing a carbonylation process stream, which consists essentially of a Group VIII noble metal catalyst and tar, with methyl iodide, (ii) contacting the mixture produced in step (i) with an extracting stream comprising either acqueous hydroiodic acid or aqueous acetic acid under conditions where at least 50% of the Group VIII noble metal is extracted into the extracting stream and the mixture and (iii) separating the extracting stream and the mixture.

3. A process as claimed in claim 2 wherein at least 80% of the Group VIII metal is extracted in step (ii).

4. A process as claimed in claim 3 wherein at least 90% of the Group VIII metal is extracted in step (ii).

5. A process as claimed in claim 1 wherein steps (e) and (f) are combined and the Group VIII metal is separated from the tar and methyl iodide by subsequent filtration.

6. A process as claimed in claim 5 wherein the filtration is carried out at a temperature of less than 100° C.

7. A process as claimed in claim 6 wherein the filtration is carried out at a temperature of less than 75° C.

8. A process as claimed in claim 1 wherein the vessel and its contents are heated to a temperature in the range 120° to 180° C.

9. A process as claimed in claim 8 wherein the vessel and its contents are heated to a temperature in the range 140° to 180° C.

10. A process as claimed in claim 1 in which steps (a), (b), (d), (e) and (f) are operated continuously and wherein the inside of the vessel is continuously isolated from the outside under an applied pressure of gas.

11. A process for recovering a Group VIII noble metal from a mixture consisting essentially of the Group VIII noble metal, tar and methyl iodide which comprises the steps of (a) obtaining a mixture consisting essentially of the Group VIII noble metal, tar and methyl iodide, (b) feeding the mixture into a vessel, (c) closing the vessel so that the contents of the vessel are isolated from the outside, (d) heating the vessel and its contents to a temperature in excess of 50° C., (e) removing the Group VIII metal in solid form from the vessel.

* * * * *